United States Patent [19]

Ghisoni

[11] 4,048,901

[45] Sept. 20, 1977

[54] RECOIL-OPERATED AUTOMATIC PISTOL

[76] Inventor: Emilio Ghisoni, Via Villa Serafina 4, Pavia, Italy

[21] Appl. No.: 681,589

[22] Filed: Apr. 29, 1976

[30] Foreign Application Priority Data

Apr. 29, 1975 Italy ..... 22834/75

[51] Int. Cl.[2] ..... F41C 3/00; F41C 15/00; F41C 17/04; F41C 19/00

[52] U.S. Cl. ..... 89/132; 42/25; 42/75 C; 89/148; 89/197; 89/199

[58] Field of Search ..... 42/6, 7, 75 C; 89/194, 89/195, 197, 199

[56] References Cited

U.S. PATENT DOCUMENTS

| | | | |
|---|---|---|---|
| 2,387,691 | 10/1945 | Sunderland | 42/75 C |
| 3,711,980 | 1/1973 | Palama | 89/197 |

*Primary Examiner*—Stephen C. Bentley
*Attorney, Agent, or Firm*—Karl F. Ross

[57] ABSTRACT

An automatic pistol with blowback action, in which a hammer is cocked by the recoil of a slidable breechblock, has a retaining member in the form of an elongate lid detachably secured to the gunstock for holding the breechblock in place, this lid carrying a backstop for a restoring spring tending to thrust the breechblock forwardly. The rear limiting position of the breechblock is defined by a pair of upstanding wings, rigid with the gunstock, against which two lateral shoulders of the breechblock come to rest upon manual arming or after the firing of a cartridge. A swingable control element on the breechblock, entrainable by a setting knob through a lost-motion coupling, has a blocking position in which it prevents the hammer from striking a firing pin lodged in the breechblock; in a working position, this element is movably interposed between the hammer and the firing pin to act as a force-transmitting device upon the release of the hammer by depression of the trigger.

19 Claims, 15 Drawing Figures

RECOIL-OPERATED AUTOMATIC PISTOL

FIELD OF THE INVENTION

My present invention relates to an automatic pistol operating by blowback action, i.e. with recurrent cocking of its spring-loaded hammer by the recoil of a breechblock slidably mounted in its gunstock.

BACKGROUND OF THE INVENTION

In conventional firearms of this type, the slidable breechblock or carriage is held in place by a retaining member which is hinged to the gunstock and is normally latached thereto. With carriage encased in a housing, a manually operable arming button with a stem traversing the retaining member must be provided to facilitate the loading of the first cartridge from a magazine clip into the breech behind the gun barrel; this button must be removed prior to disassembly for inspection and cleaning purposes. Even where the carriage is not encased, such disassembly is rather cumbersome in the known automatic pistols of this type and generally requires removal of the barrel from the gunstock. Finally, the need for a rear carriage stop on the gunstock prevents a mounting of the hammer at an external, readily accessible location behind the breechblock.

OBJECT OF THE INVENTION

The object of my present invention, therefore, is to provide an improved mounting for the slidable breechblock and the associated firing mechanism which obviates the aforestated disadvantages.

SUMMARY OF THE INVENTION

In accordance with my present invention, a breechblock slidable along a track of a gunstock between a forward position close to the gun barrel and a retracted position remote therefrom, urged forwardly by a restoring spring, is guided by a retaining member which is detachably secured to the gunstock at three points, i.e. at an elevated land adjacent the barrel and at a pair of rigid upstanding wings flanking a rear portion of the track. Thus, the breechblock is laterally bracketed by the wings of the gunstock and is engaged from below and from above by the body of the gunstock and by the retaining member, respectively; upon a detachment of that member, it can therefore be readily extracted and reinserted. The hammer, mounted at the rear of the track, has unobstructed access to the breechblock for striking a firing pin slidably lodged therein upon being cocked initially by a manual retraction of the breechblock and subsequently by the recoil thereof after the firing of one or more cartridges.

Pursuant to another important feature of my invention, the front edges of the wings form an abutment engageable with an enlarged front part of the breechblock in its retracted position to limit its recoil.

According to a further important feature, the retaining member is provided with a backstop for the restoring spring of the breechblock, this backstop being advatangeously a bifurcation straddling a rod around which that spring is coiled. The rod, spanning a pair of end walls of the breechblock, forms an integral part of the latter and thus increases its moment of inertia utilized for the cocking of the hammer.

According to still another feature of my present invention, the hammer strikes the firing pin not directly but through the intermediary of an interposed control elememt which is pivotally mounted on the breechblock for manual swinging between a working position and a blocking position. In the latter position, the control element prevents a relative displacement of the firing pin and the breechblock by the hammer so as to enable a safe release of that hammer after it has been cocked. The control element is manually positionable with the aid of an external setting knob on the breechblock, advantageously through a lost-motion coupling which allows that element to oscillate independently on the knob in its working position upon being struck by the hammer.

BRIEF DESCRIPTION OF THE DRAWING

The above and other features of my invention will now be described in detail with reference to the accompanying drawing in which.

SPECIFIC DESCRIPTION

Figure 1:
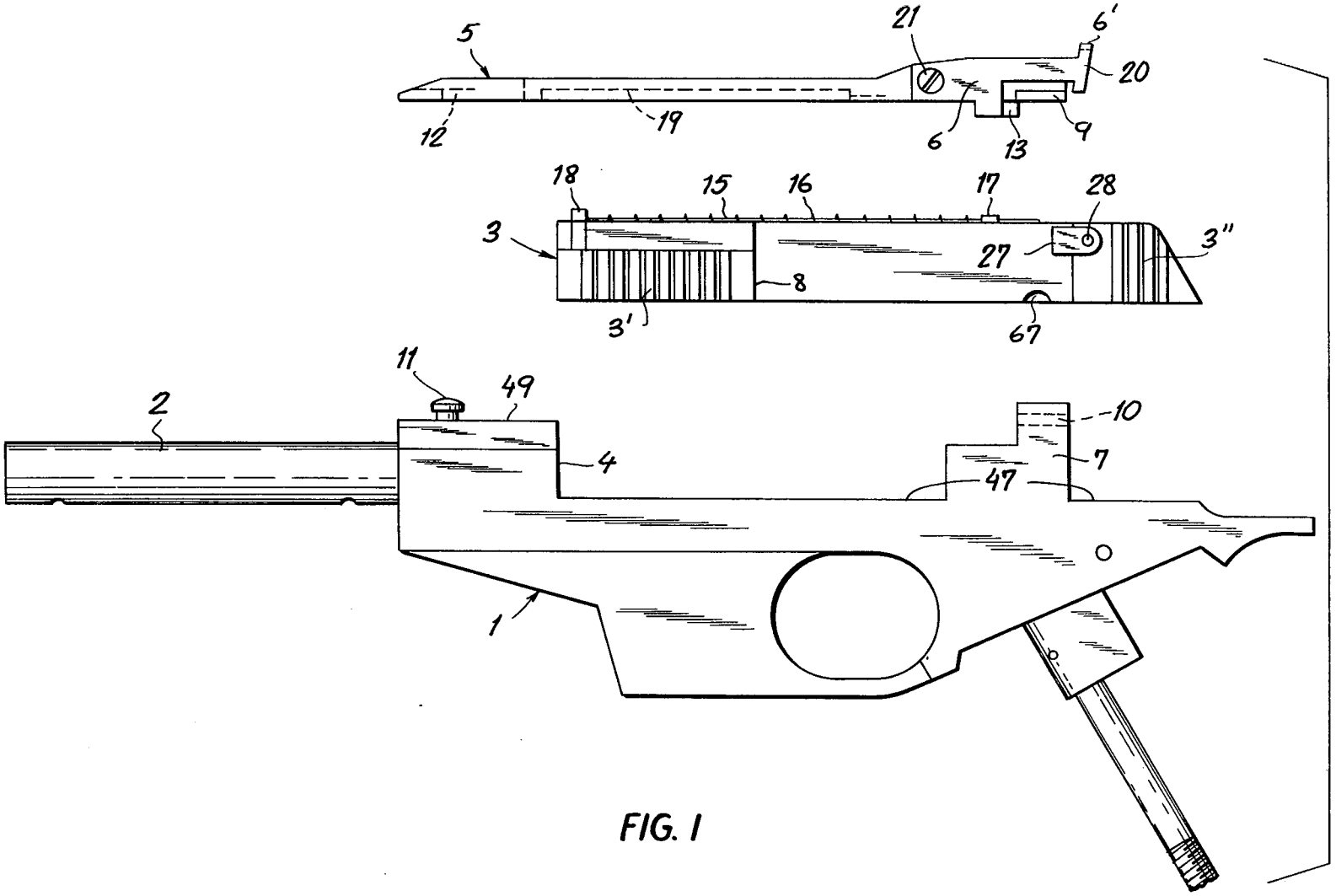
FIG. 1 is an exploded side-elevational view of the principal components of an automatic pistol embodying my invention, including a gunstock, a breechblock and a retaining member.

As shown in the drawing, an automatic pistol according to my invention comprises essentially a gunstock 1 with barrel 2 (which may be rifled in the usual manner), a breechblock 3 slidable along a track 47 formed by the breech 4 of the gunstock, and a retaining member 5 in the form of an elongate lid adapted to be detachably secured to the gunstock 1 above track 47.

A magazine 48 (FIG. 9) for the insertion of an ammunition clip, not further illustrated, opens onto the front of track 47 just behind the barrel 2.

Figure 4:
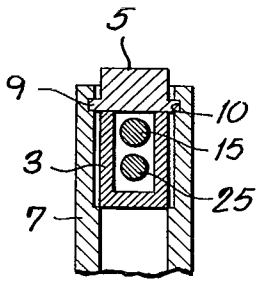
FIG. 4 is a cross-sectional view taken on the line IV — IV of FIG. 2.
Figure 6:
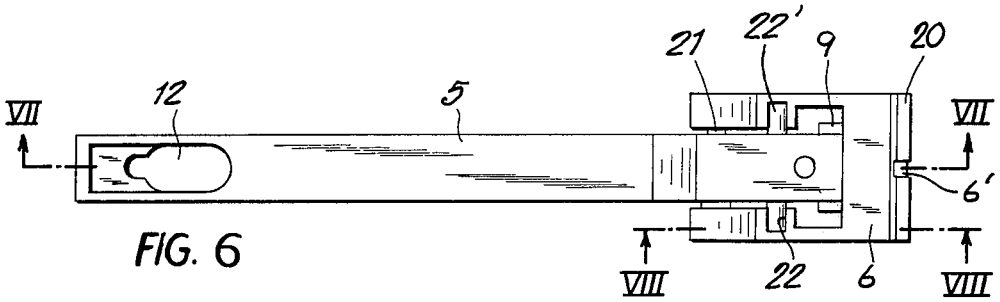
FIG. 6 is a top view of the retaining member.
Figure 5:
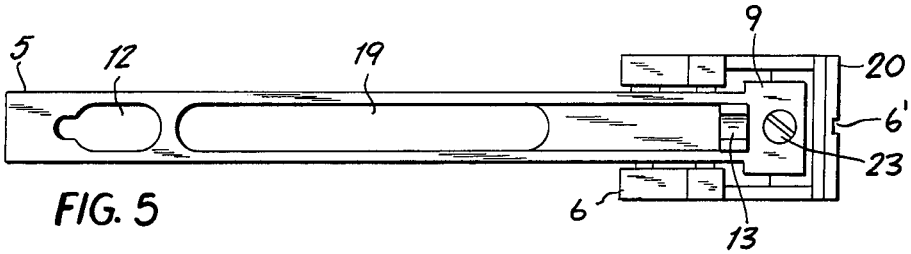
FIG. 5 is a bottom view of the retaining member.
Figure 7:
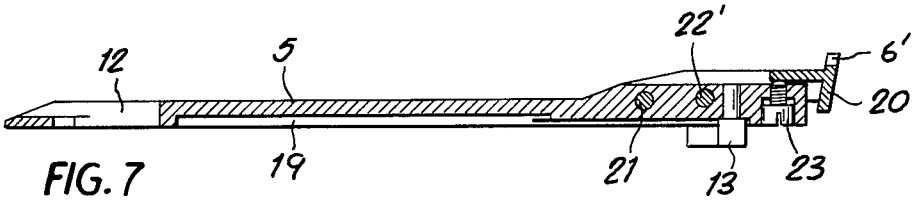
FIG. 7 is a longitudinal sectional view taken on the line VII — VII of FIG. 6.
Figure 8:
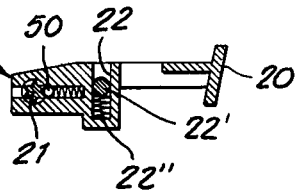
FIG. 8 is a sectional detail view taken on the line VIII — VIII of FIG. 6.
Figure 14:
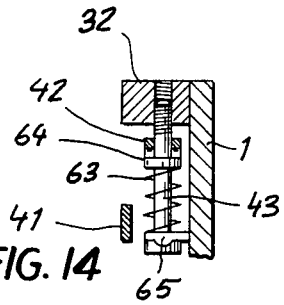
FIGS. 14 and 15 are cross-sectional views respectively taken on line XIV — XIV of FIG. 12 and on line XV — XV of FIG. 13.

Lid 5 is provided with a generally yoke-shaped extension 6 articulated to it by a pin 21 for swinging in a vertical plane, the bight of the yoke carrying a rear gunsight 6' coacting with a front gunsight 2' at the tip of a separate member encasing the barrel 2. Underneath the sight 6' the yoke 6 forms a lug 20 engaging behind a pair of upstanding wings 7 which are rigid with gunstock 1 and flank the track 47. As shown in FIGS. 1 and 4, the wings 7 have horizontal grooves 10 matingly receiving a pair of ribs 9 of lid 5 while a cutout 12 of that lid is engaged by a latch 11 rising from an elevated land 49 of the gunstock adjacent barrel 2. Thus, the lid 5 can be detached from the gunstock by forward sliding upon a lifting of yoke 6 to disengage the lug 20 from the wings 7, as indicated in phantom lines in FIG. 2. That disengagement is resisted by a pair of springs 22'', one of which is shown in FIG. 8, received in confronting channels 22 of yoke 6 (see also FIG. 6); these springs bear from below upon opposite ends of a transverse pin 22' projecting from lid 5. The arms of yoke 6 also accommodate a pair of ball checks 50, FIG. 8, which coact with pivot pin 21 to index the yoke in one of several positions of different inclination for the purpose of properly aligning the two sights 2' and 6' with each other. The selected angle of inclination is maintained with the aid of an adjustable seat for the yoke, formed by a setscrew 23 in a vertical bore of lid 5.

Figure 2:
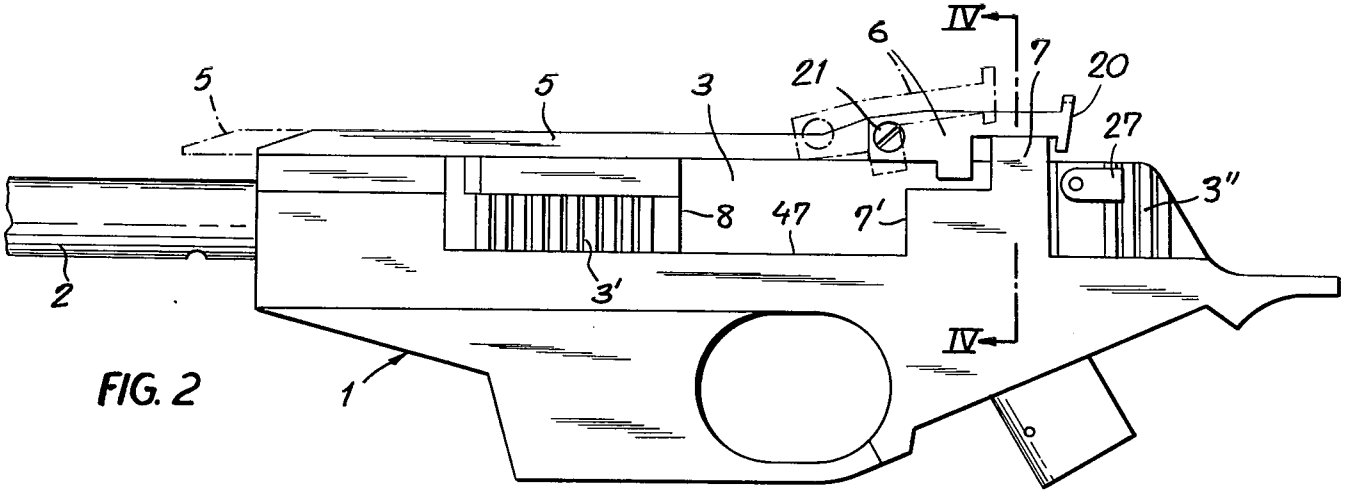
FIG. 2 is a similar view of the same components in their assembled state.

The front edges 7' of wings 7 face a pair of shoulders 8, formed by an enlarged front portion or head 3' of breechblock 3, to limit the recoil of that block upon the detonation of a cartridge introduced from magazine 48 into barrel 2. For insertion of the first cartridge, the breechblock 3 can be manually retracted by a gripping of front portion 3' whose exposed sides are corrugated for this purpose as seen in FIGS. 1 and 2. A similarly corrugated rear portion or head 3'' of the breechblock has the same width as front portion 3' and projects laterally behind the wings 7. As will be readily apparent, this two-headed breechblock can be easily detached from the gunstock 1 upon the removal of the overlying lid 5 and can be just as easily re-emplaced preparatorily to a relatching of the lid with the aid of coacting formations 9 - 12.

Figure 3:
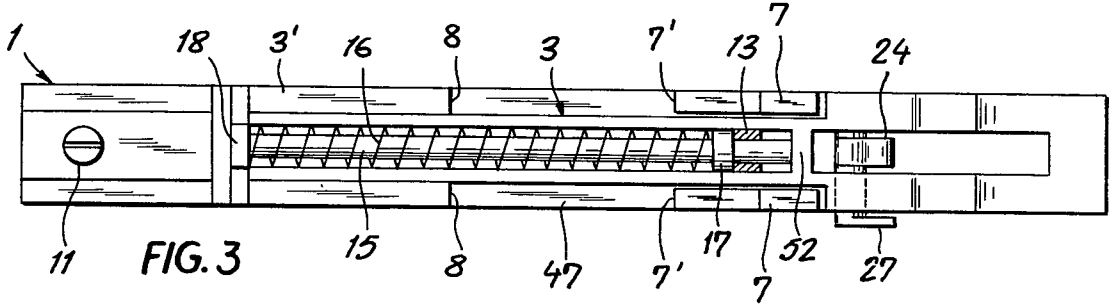
FIG. 3 is a top view of the assembly of FIG. 2 with the retaining member omitted.
Figure 10:
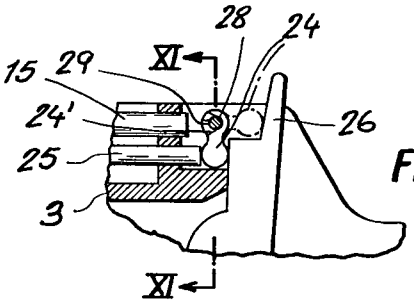
FIG. 10 shows parts of the assembly of FIG. 9 with the hammer released but blocked.
Figure 11:
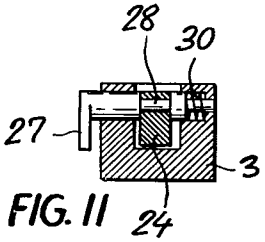
FIG. 11 is a cross-sectional view taken on the line XI — XI of FIG. 10.
Figure 9:
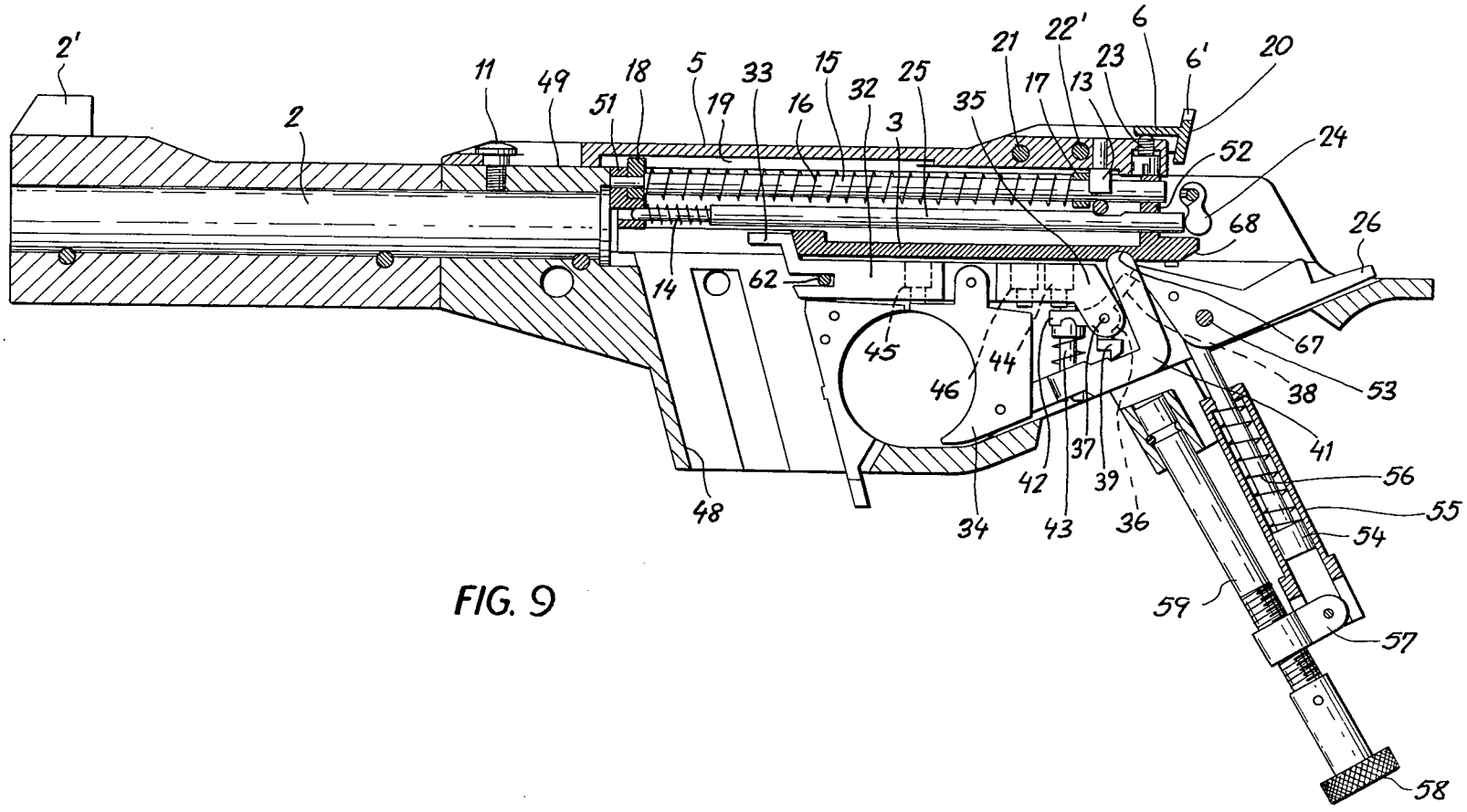
FIG. 9 is a longitudinal sectional view of the pistol with its hammer cocked.

Breechblock 3 is biased into its forward position, illustrated in FIGS. 2, 3 and 9, by a restoring spring 16 coiled about a rod 15 which is held in front and rear end walls 51, 52 of the breechblock. The rear end of coil spring 16 bears upon an annular spacer 17 which slidably surrounds the rod 15 and is pressed by the spring against a bifurcate backstop 13 depending from lid 5. Thus, any retraction of breechblock 3 by manual force or by recoil compresses the spring 16 between front wall 51 and backstop 13, the force so stored in the spring serving to load the barrel 2 with a fresh cartridge thrust into the breech 4 during the retraction of the breechblock. A lug 18 at the front of the breechblock, sliding in a longitudinal groove 19 on the undersurface of lid 5, helps provide rectilinear guidance for the movement of the breechblock.

A firing pin 25 is slidably held in the end walls 51 and 52 of breechblock 3 and is biased rearwardly by a spring 14 (FIG. 9) so as to project from the block into the path of a hammer 26 which is pivotally mounted on the gunstock by a pin 53 and is biased in a counterclockwise sense, as viewed in FIG. 9, by a piston 54 in a cylinder 55 containing a loading spring 56. The lower end of cylinder 55 is linked via a strap 57 with a knob 58 on a threaded stem 59 for varying the force of that spring. The hammer is held in its cocked position, shown in FIG. 9, by an arm 38 of a three-armed sear as more fully described hereinafter.

A control element 24, illustrated in FIGS. 3 and 9 - 11, is mounted within a recess of breechblock 3 just behind the projecting rear extremity of firing pin 25 on a transverse pin 28 on which it is freely swingable within the limits of a lost-motion coupling comprising a tooth 29 on pin 28 received in a cutout 24' of element 24. Pin 28 is rigid with a knob 27 which is manually displaceable between two positions respectively illustrated in FIGS. 1 and 2 in which the knob can be indexed by the engagement of the tooth 29, under pressure of a spring 30, with either of two diametrically opposite notches (not shown) in the wall supporting the knob 27. With the knob positioned as shown in FIG. 2, element 24 assumes a position indicated in phantom lines in FIG. 10 in which it intercepts the hammer 26 when the latter is released from its cocked position upon the depression of a trigger 34 as described below. In this blocking position, therefore, the hammer cannot strike the firing pin 25 so that a cartridge then resting in the rear end of barrel 2 will not be detonated. When the knob 27 is moved through 180° into its alternate position shown in FIG. 1, control element 24 follows that movement by its own weight over approximately 90° to assume the working position shown in full lines in FIG. 10 and also depicted in FIGS. 9 and 11. In this working position the lower end of element 24 interposes itself between the firing pin 25 and the hammer 26 so as to transmit the force of the latter upon the firing pin, causing detonation of the cartridge. The indexed knob 27, being decoupled from element 24, does not interfere with this operation.

Figure 12:
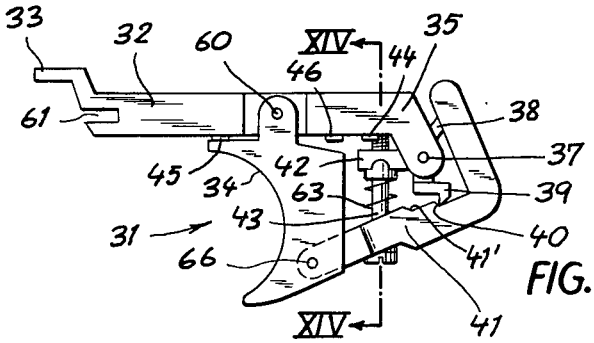
FIG. 12 is a side-elevational view of a unit forming part of the firing mechanism of the pistol.
Figure 15:
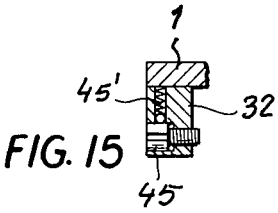
Figure 13:
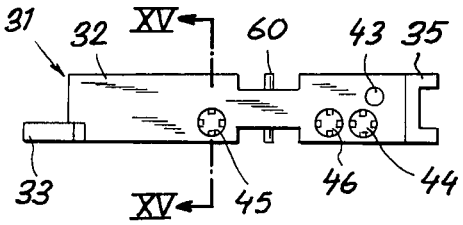
FIG. 13 is a top view of the unit shown in FIG. 12.

In FIGS. 9 and 12 - 15 I have shown further details of the firing mechanism including the hammer 26 and the trigger 34. This mechanism, according to a feature of my invention, comprises an externally preassembled unit 31 including a support 32 for the trigger, this support terminating at its front in a beak 33 serving as an ejector for spent cartridges. As seen in FIG. 13, ejector 33 is laterally offset from the barrel axis so as to deflect the recoiling cartridge shell into the lateral gap formed between gunstock 1 and lid 5 on the opposite side of the barrel axis, the shell thus moving upwardly out of the breech as viewed in FIGS. 3 and 13. Support 32 is a metal strip to which the trigger 34 is articulated at 60 and which has a slot 61 receiving a fixed pin 62 on the gunstock. The stroke of the trigger is limited by two adjustable stops formed by setscrews 45 and 46.

A bifurcate rear extremity 35 of support 32 carries a transverse pin 37 serving as an axle for the rotable sear with arms 38, 39 and 42. Arm 42 is traversed by a screw 43 which is threaded into the support 32 and is surrounded by a spring 63 pressing that arm from below, through a shoe 64, against an adjustable stop 44 also formed by a setscrew in support 32. A fork 65 on gunstock 1 straddles the screw 43 and indexes it in a selected position; pin 62, fork 55 and other fastening elements (not shown) serve to hold the support 32 in its illustrated position on gunstock 1. The stops 44, 45 and 46 are indexable by associated ball checks as illustrated at 45' in FIG. 15 for the screw 45.

An actuating lever 41 is articulated to trigger 34 at 66 and has a step 40 coacting with the pawl-shaped arm 39 of the sear to rotate the latter counterclockwise, as viewed in FIG. 12, when the trigger 34 is repressed against the force of spring 63 resisting this rotation. The arm 38 is thereby disengaged from the cocked hammer 26 which can thereupon swing into its striking position shown in FIG. 10. Lever 41 has a free end normally received in a notch 67 (see also FIG. 1) of breechblock 3 from which it is cammed out as the breechblock recoils, thereby releasing the pawl 39 from the step 40 and allowing the arm 38 to recock the hammer 26 when the latter is returned to the position of FIG. 9 by a beveled edge 68 of the retreating breechblock. With a return of the breechblock to its forward position by the force of spring 16, lever 41 snaps back into notch 67 and, with trigger 34 still held depressed, elevates the pawl 39 by an edge 41' so that the sear again turns counterclockwise and releases the hammer for another detonation. The firing rate can be varied by adjustment of screws 43 and 44. Thus, the preassembled unit 31 includes not only the trigger 34 and the sear 38, 39, 42 but also means for modifying the operation of these elements.

I claim:

1. An automatic pistol comprising:

a gunstock with a gun barrel adapted to receive a succession of cartridges from a magazine, said gunstock forming a track to the rear of said gun barrel;

a breechblock slidable along said track between a forward position adjacent said gun barrel and a retracted position remote therefrom, said breechblock being provided with a restoring spring urging same into said forward position;

a firing mechanism on said gunstock including a trigger and a spring-loaded hammer at the rear of said track releasable by said trigger from a cocked position to strike a firing pin slidably lodged in said breechblock for detonating a cartridge introduced into said gun barrel upon a retraction of said breechblock from said forward position, said breechblock being displaceable by recoil into said retracted position upon the detonation of said cartridge and being engageable with said hammer upon such displacement to recock said hammer preparatorily to another detonation;

a pair of upstanding wings rigid with said gunstock flanking a rear portion of said track and bracketing said breechblock therebetween, said wings having front edges forming an abutment engageable with an enlarged front part of said breechblock in said retracted position thereof; and a retaining member detachably secured to said gunstock at said wings and at an elevated land adjacent said gun barrel for guiding said breechblock along said track.

2. A pistol as defined in claim 1 wherein said retaining member is provided with a backstop for said restoring spring.

3. A pistol as defined in claim 2 wherein said breeechblock has front and rear end walls spanned by a rod, said backstop being a bifurcation straddling said rod, said restoring spring being coiled around said rod, further comprising a spacer slidable along said rod between said restoring spring and said bifurcation.

4. A pistol as defined in claim 2 wherein said gunstock and said retaining member are slidably interfitted by mating formations and are elastically held in a predetermined relative position by the pressure of said restoring spring upon said backstop.

5. A pistol as defined in claim 4 wherein said retaining member comprises an elongated lid with an articulated rear extension terminating in a lug engageable with said wings for normally preventing disengagement of said formations from each other.

6. A pistol as defined in claim 4 wherein said formations include a pair of longitudinal ribs on said retaining member and a pair of complementary grooves on confronting surfaces of said wings.

7. A pistol as defined in claim 6 wherein said formations further include a cutout at a front end of said retaining member and a catch on said land engaged in said cutout.

8. A pistol as defined in claim 1, further comprising a control element pivotally mounted on said breechblock behind said firing pin for manual swinging between a blocking position and a working position, said control element preventing relative displacement of said firing pin and said breechblock by said hammer in said blocking position, said control element being movably interposed between said firing pin and said hammer in said working position for transmitting the force of the hammer to the firing pin.

9. A pistol as defined in claim 8, further comprising a setting knob for said control element on said breechblock and a lost-motion coupling between said knob and said control elememt.

10. A pistol as defined in claim 1 wherein said firing mechanism further comprises a release assembly for the hammer including a support having said trigger articulated thereto and an actuating lever linked with said trigger, said assembly being mounted beneath said track on said gunstock and being detachable therefrom as a unit.

11. A pistol as defined in claim 10 wherein said assembly further includes adjustable biasing means bearing upon said actuating lever for varying the firing rate.

12. A pistol as defined in claim 11 wherein said assembly further includes a rotatable sear on said support with a first arm engageable with said hammer upon a cocking thereof, a second arm entrainable by said actuating lever, and a third arm engaged by said biasing means.

13. A pistol as defined in claim 10 wherein said assembly further includes a pair of adjustable end stops for limiting the stroke of said trigger.

14. A pistol as defined in claim 10 wherein said assembly further includes an ejector for spent cartridges rigid with said support.

15. An automatic pistol comprising:

a gunstock with a gun barrel adapted to receive a succession of cartridges from a magazine, said gunstock forming a track to the rear of said gun barrel;

a breechblock slidable along said track between a forward position adjacent said gun barrel and a retracted position remote therefrom, said breechblock being provided with front and rear walls spanned by a rod;

a restoring spring coiled around said rod for urging said breechblock into said forward position;

a firing mechanism on said gunstock including a trigger and a spring-loaded hammer at the rear of said track releasable by said trigger from a cocked position to strike a firing pin slidably lodged in said breechblock for detonating a cartridge introduced into said gun barrel upon a retraction of said breechblock from said forward position, said breechblock being displaceable by recoil into said retracted position upon the detonation of said cartridge and being engageable with said hammer upon such displacement to recock said hammer preparatorily to another detonation;

a pair of upstanding wings rigid with said gunstock flanking a rear portion of said track and bracketing said breechblock therebetween;

a retaining member detachably secured to said gunstock at said wings and at an elevated land adjacent said gun barrel for guiding said breechblock along said track, said retaining member being provided with a bifurcation straddling said rod as a backstop for said restoring spring; and a spacer slidable along said rod between said restoring spring and said bifurcation.

16. An automatic pistol comprising:

a gunstock with a gun barrel adapted to receive a succession of cartridges from a magazine, said gunstock forming a track to the rear of said gun barrel;

a breechblock slidable along said track between a forward position adjacent said gun barrel and a retracted position remote therefrom, said breechblock being provided with a restoring spring urging same into said forward position;

a firing mechanism on said gunstock including a trigger and a spring-loaded hammer at the rear of said track releasable by said trigger from a cocked position to strike a firing pin slidably lodged in said breechblock for detonating a cartridge introduced into said gun barrel upon a retraction of said breechblock from said forward position, said breechblock being displaceable by recoil into said retracted position upon the detonation of said cartridge and being engageable with said hammer upon such displacement to recock said hammer preparatorily to another detonation;

a pair of upstanding wings rigid with said gunstock flanking a rear portion of said track and bracketing said breechblock therebetween; and an elongate lid detachably secured to said gunstock at said wings and at an elevated land adjacent said gun barrel for guiding said breechblock along said track, said lid being provided with a backstop for said restoring spring, said gunstock and said lid being slidably interfitted by mating formations and being elastically held in a predetermined relative position by the pressure of said restoring spring upon said backstop, said lid being further provided with an articulated rear extension terminating in a lug engageable with said wings for normally preventing disengagement of said formations from each other.

17. A pistol as defined in claim 16, further comprising a gunsight on said extension.

18. A pistol as defined in claim 17, further comprising adjustable stop means on said retaining member for changing the elevation of said gunsight and spring means urging said extension from above onto said stop means, said lug being disengageable from said wings upon a swinging of said extension against the force of said spring means.

19. A pistol as defined in claim 16 wherein said formations include a pair of longitudinal ribs on said lid, a pair of complementary grooves on confronting surfaces of said wings, a cutout at a front end of said lid and a catch on said land engaged in said cutout.

* * * * *